US005857300A

United States Patent [19]

Gates

[11] Patent Number: 5,857,300

[45] Date of Patent: Jan. 12, 1999

[54] ADJUSTABLE RADIUS FORM ASSEMBLY

[75] Inventor: H. Gordon Gates, Lakewood, Colo.

[73] Assignee: Gates & Sons, Inc., Denver, Colo.

[21] Appl. No.: 939,568

[22] Filed: Sep. 29, 1997

[51] Int. Cl.[6] ..... E04G 11/10

[52] U.S. Cl. ..... 52/426; 249/18; 249/10; 249/210; 52/427; 52/428; 52/562; 52/379; 52/508; 52/285.2; 52/506.05

[58] Field of Search ..... 52/426, 427, 428, 52/562, 506.05, 508, 285.2, 285.4, 378, 379; 249/18, 188–194, 212

[56] References Cited

U.S. PATENT DOCUMENTS

| | | | |
|---|---|---|---|
| 4,185,805 | 1/1980 | Ewing | 249/210 |
| 4,619,433 | 10/1986 | Maier | 249/18 |
| 4,915,345 | 4/1990 | Lehmann | 249/18 |
| 5,125,617 | 6/1992 | Miller | 249/18 |
| 5,492,303 | 2/1996 | Jaruzel | 249/4 |

OTHER PUBLICATIONS

Gates Concrete Forming Systems brochure, 1001 Commercial Systems, "Gates Concrete Forming Systems", updated Aug. 1986.

Gates Concrete Forming Systems brochure, 1001 Commercial Systems, "Gates Concrete Forming Systems", 1980, p. 6.

Gates & Sons, Inc. brochure, 1000—Radius Steel Walers, "Tricks of the Trade InFORMation",, 1980, back page.

Gates Concrete Forming Systems brochure, No. 1401, "Gates Commercial Forming Systems".

Gates Concrete Forming Systems—InFORMation, brochure 101, "Gates Horizontal Rod Panel System Provides Economy, Flexibility and Ease of Transportation", vol. No. 12.

Gates Concrete Forming Systems—InFORMation brochure No. 500 "Does Your Job Merit 5 M Anchor Lock Ties", vol. No. 16, 1972.

Gates Concrete Forming Systems—InFORMation brochure No. 401, "Another Revolutionary Idea From Gates", vol. No. 15, 1968.

InFORMation Tricks of the Trade—Gates Concrete Forming Systems brochure No. 302, "Work Smarter Not Harder With Gates Concrete Forming Systems".

Gates Anchor–Lock Forming System brochure, No. 400, "Regular Anchor–Lock #3 Forming System", Updated Oct. 1986.

Gates Anchor–Lock Forming System brochure, No. 400 "Faster and better forming than ever before with . . . "AIA File 4–D–3, 1970.

Gates Concrete Forming System brochure No. 700, "All New Heavy Duty V–Lock System", 1978.

(List continued on next page.)

*Primary Examiner*—Christopher Kent
*Assistant Examiner*—Yvonne Horton-Richardson
*Attorney, Agent, or Firm*—Fields and Johnson, P.C.

[57] ABSTRACT

An adjustable radius form assembly is provided which includes a plurality of vertical strongbacks and a plurality of horizontal walers. Each of the walers are pre-rolled to a desired radius. The walers are then connected to one another by ball and socket type adjusters which enable the end to end arrangement of the walers to accommodate an overall form assembly having a wide range of curvatures or radii. The plurality of end to end walers and plurality of corresponding strongbacks may define a gang form length. A number of gang form lengths may be connected to one another to create the desired form assembly for the structure to be constructed. The vertical strongbacks may be placed at desired spacings along the horizontal lengths of the corresponding walers by adjustment of connectors on said strongbacks extending through slotted plates on the walers. The exact number and spacing of walers and strongbacks used in the form assembly are dictated by the size and strength requirements of the structure to be constructed.

33 Claims, 14 Drawing Sheets

OTHER PUBLICATIONS

Gates Horizontal Rod—Low Wall—Panel Forming brochure, "Faster and better forming than ever before with . . . ", AIA File 4–D–3, Rev. 1959.

Gates, "Suggested Forming Details", p. 2004, 1971.

Formwork Exchange, Ltd., Fax diagram of form, Sep. 21, 1992.

Formwork Exchange, Ltd., one–page flyer, "New Articulated Adjustable Water".

Waco Scaffolding & Equipment, "Steel Adjustable Radius Waler", Sep. 30, 1992.

Gates, "Cam–Lock Forming System", Catalog 1, 300A, 1984.

Gates Cam–Lock Forming System brochure, 300 Cam–Lock, "Faster and better forming than ever before with . . . ".

Gates Anchor–Lock #5 Forming System brochure 500, Anchor–Lock #5, "Anchor–Lock #5 Forming System".

Gates Anchor–Lock—10,000 Lb.—Forming System brochure No. 600, "Faster and better forming than ever before with . . . ", AIA File 4–D–3, 1971.

Gates Anchor–Lock #5 Forming System brochure 500 Medium Anchor–Lock #5, "Medium Anchor–Lock #5 Forming System", Updated Apr. 1986.

Gates Anchor–Lock Forming System brochure 400 Regular Anchor–Lock #3, "Regular Anchor–Lock #3 Forming System", Updaated Dec. 1995.

Gates Horizontal Rod Panel Forms brochure No. 100–2–1/2M—6–75, "Faster and better forming than ever before with . . . ", rev. 1975.

20
31
33
34
35
36
37
38
39
41
6
7
8
9

24
40
43
44
45
46
47
48
49
51
16
17
18
19

25
21
22
23
24
40
44
45
46
47
48
49
51
66
67
68

24/25
45
46
48
44
49
60
32
70
a1
a2
43
71
72
74
75
76
77
78
79

32b
32
25
60
49
24

51
62
X 21
41
39
20

33b
30

ADJUSTABLE RADIUS FORM ASSEMBLY

TECHNICAL FIELD

This invention relates to an assembly that provides support for a concrete structure to be formed and, more particularly, to an assembly including adjustable radius walers which enable the assembly to support the formation of concrete structures having differing curved shapes.

BACKGROUND ART

It is well known in the art of concrete forms to construct forms by which a curved or irregular shaped concrete structure can be made. One major drawback of concrete forms used in the past to create such irregular or curved shaped concrete structures was that in most cases special forms had to be constructed each time the curved or irregular concrete structure was formed. In other words, the concrete forms used to support the formation of the concrete structures could not be used again since such forms were specially made for the particular structure. Circular shaped concrete structures are an example of common structures which require the construction of special forms. Additionally, commonly available form assemblies require large numbers of bolts and brackets to attach walers to strongbacks in the desired configuration. When the form assembly is to be readjusted for another job, the forms must be laid on their backs and the brackets and bolts removed to reposition the walers. The walers can unintentionally be moved longitudinally with respect to the strongbacks during these adjustments. This makes readjustment difficult and labor-intensive, not to mention additional cost in time and materials due to misplacement or loss of some of the brackets during the readjustment.

In order to avoid the unnecessary time and costs involved with creating concrete forms for each circular or irregular structure to be made, it is desirable to have form assemblies which can be used in numerous applications to accommodate differing sized circular or irregular curved shaped structures to be made.

DISCLOSURE OF THE INVENTION

In accordance with this invention, an adjustable radius form assembly is provided which enables the creation of circular or curved shaped concrete structures.

The structure of the form assembly of this invention includes a plurality of vertically extending and horizontally spaced members or strongbacks which are maintained in their horizontal spaced arrangement by a plurality of horizontally extending and vertically spaced members or walers. The form assembly can be arranged with an exterior form group and an interior form group which is spaced from the exterior form group a desired distance, the spacing defining the thickness of a wall of a concrete structure to be formed. The interior form group is a mirror image of the exterior form group. That is, the elements which comprise the exterior form group are identically found in the interior form group except that the exterior and interior walers have different curvatures to accommodate the particular thickness of the wall to be formed. The form assembly of this invention is made adjustable by the plurality of adjustable walers. The form assembly of this invention is also considered one integral unit in that all of the components necessary to adjust the form assembly to a particular shape are attached to the form assembly.

The terms "inside" or "interior" and "outside" or "exterior" as defined herein are descriptive terms to describe the various structural members of the form assembly as it is assembled in use and as illustrated in FIGS. 1–3. More specifically, the interior or inside edge or side of a particular structural member is defined as the edge seen if one could view that particular structural member from the center of the concrete structure to be formed. Similarly, the exterior or outside edge or side of a particular structural member is defined as the edge seen if one could view that member exteriorly of or from outside of the form assembly.

The vertical members or strongbacks may be constructed of aluminum or steel channel-type structures, or may be constructed of lumber. The rest of the structural members of the form assembly are preferably constructed of a high strength metal such as aluminum or steel. The interior edge or side of the exterior strongbacks attaches to outside form sheets which define the exterior surface of the concrete wall to be formed. Similarly, the exterior edge or exterior side of the interior strongbacks are adapted to attach to inside form sheets which define the interior wall of the concrete structure to be formed.

The radius of the form assembly can be modified by the use of the adjustable walers which include ball and socket type adjustment members or adjusters. In broad terms, the ball and socket type adjustment members are adjusters which interconnect between brackets mounted at the ends of two adjacent walers, the adjuster including a threaded rod or stabilizing member, at least one receiving member for receiving the rod therethrough, and at least one securing member, such as a nut, for securing the receiving member at a desired position along the rod, the position defining a desired amount of rotation or desired angular relationship between one of the adjacent waler members with respect to the other adjacent waler member. In the preferred embodiment, the adjusters are found in groups of two which share a common rod or stabilizing member. By providing the adjustable waler members, the curvature of the interior and exterior form groups can be selectively altered to provide the formation of a concrete structure with the desired curvature. The ball and socket arrangement assures that the nuts are aligned with the threaded rods at all angles of adjustment so that they do not bind up. The inside and outside or interior and exterior form groups can be made into a circular shape, or can otherwise be configured into a desired curved shape which does not result in a closed figure such as the circle. In the preferred embodiment, the interior and exterior walers are pre-rolled to a 45' radius; however, with their adjustable capability, the radius of the concrete structure to be formed can be anywhere between 30' to 80'.

An important feature of this invention which facilitates the changes in curvature is the use of connecting plates along the walers which each have a longitudinal slot for receiving a connecting bolt on a strongback. These bolts are adjustably moved along the respective slots when changing the radius of the forms so that a uniform spacing of the strongbacks can be maintained when forming curved walls of differing diameters. Conveniently, a first fastener secures the bolts to the strongbacks and a second fastener secures the walers to the strongback so that the vertical positioning of the walers with respect to the strongbacks is maintained by the first fasteners when the second fasteners are loosened to change the radius of the forms.

The advantages of the invention described herein will be further apparent by the following description taken in conjunction with the accompanying drawings.

BEST MODE FOR CARRYING OUT THE INVENTION

Figure 1:
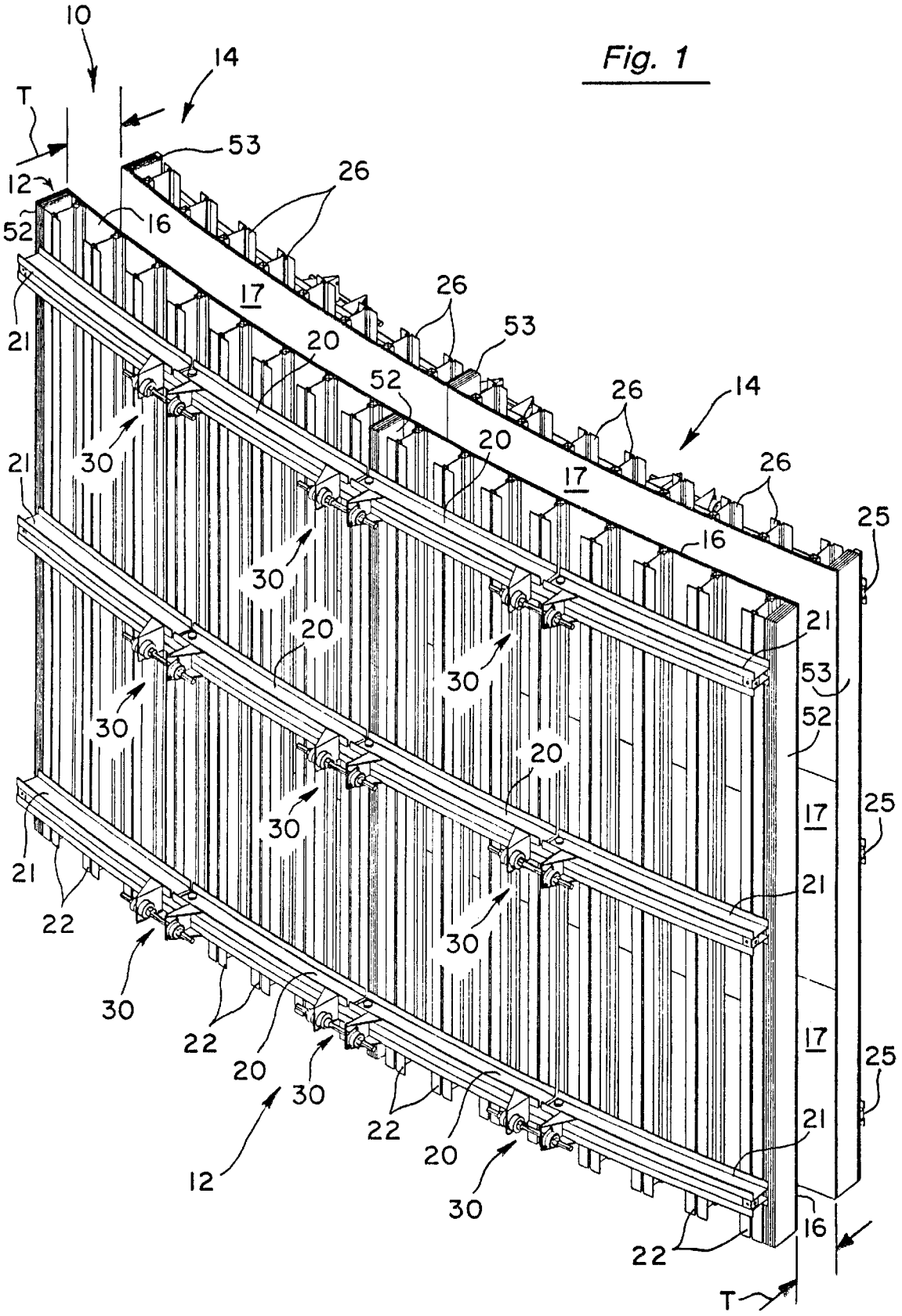
FIG. 1 is a perspective view of the adjustable radius form assembly of this invention illustrating an inside form group placed adjacent an outside form group and spaced from one another a desired distance to provide a space or gap in which a desired curved shaped concrete structure can be formed.

FIG. 1 illustrates the adjustable form assembly of this invention. This figure discloses the adjustable radius form assembly 10 comprising an outside or exterior form group 12 and an interior or inside form group 14. Inside form group 14 is a mirror image of the outside form group 12. In other words, each of the structural elements found in the outside form group are also found in the corresponding inside form group. The thickness of the concrete structure to be made is defined by the spacing between form groups 12 and 14 and is illustrated as thickness T in FIG. 1. The actual inner or interior and outer or exterior faces of the concrete structure to be formed are more specifically delimited by form sheets 16 and 17 which attach to corresponding members on the outside and inside form groups 12 and 14 as further explained below.

Outside form group 12 includes a plurality of vertically extending members and a plurality of horizontally extending members. More specifically, the vertically extending members are in the form of exterior strongbacks 22 which are spaced horizontally from one another and are the structures to which outside form sheets 16 are attached. The horizontally extending members are in the form of exterior double plate walers 20 and exterior single plate walers 21 which attach to the exterior sides of exterior strongbacks 22 and provide the means by which the curvature or radius of the outside form group can be adjusted.

Figure 2:
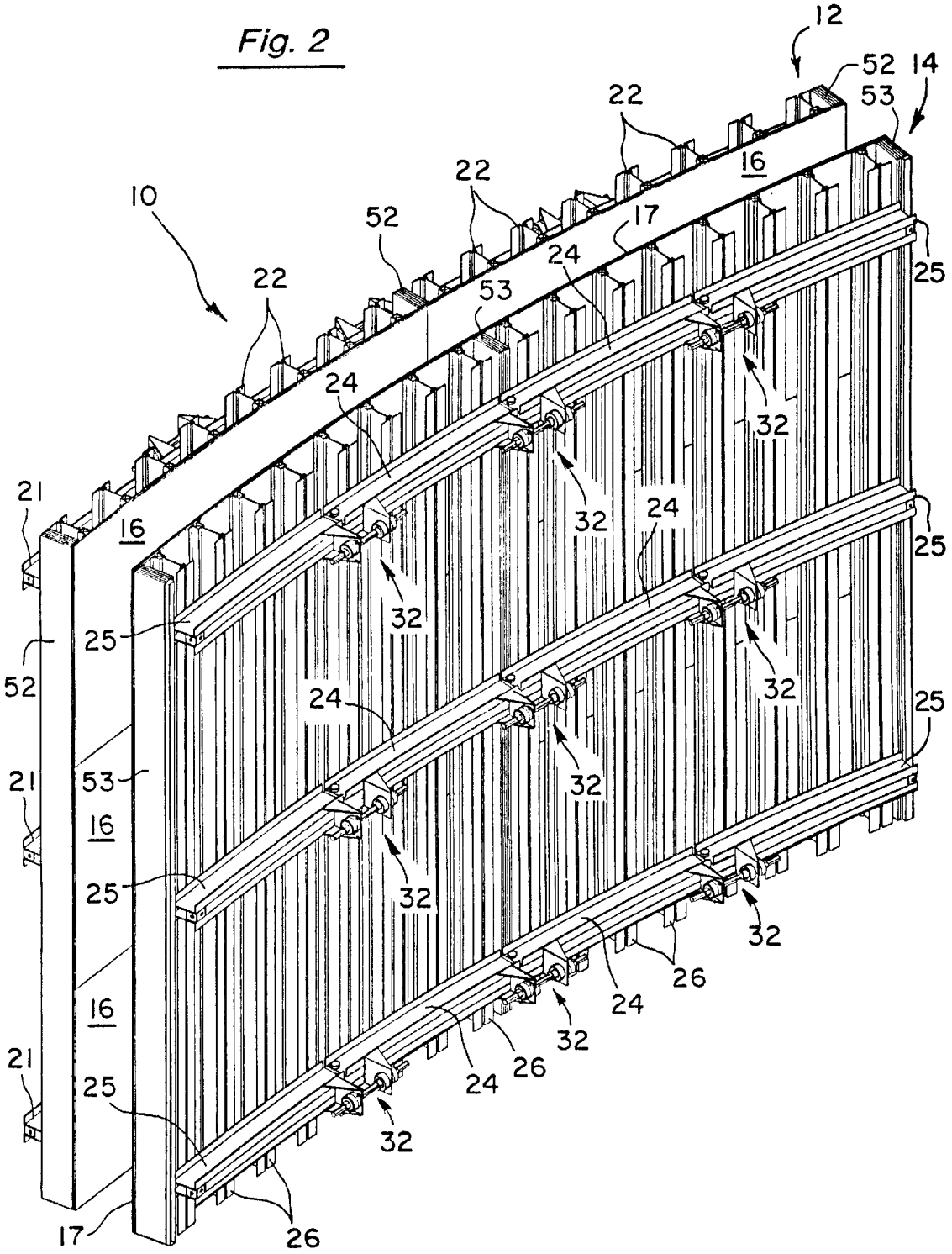
FIG. 2 is another perspective view of the adjustable radius form assembly of this invention of FIG. 1, but as viewed from the inner or interior side.

As shown in FIG. 2, the interior or inside form group 14 is also defined by a plurality of vertically extending members and a plurality of horizontally extending members. These members are defined by the same type of structures which are found in the outside form group 14. Specifically, group 14 includes interior strongbacks 26, interior single plate walers 25, and interior double plate walers 24. The interior walers 24 and 25 provide the means by which the curvature or radius of the inside form group can be adjusted.

Exterior ball and socket type adjuster groups 30 attach to each of the adjacent plates on walers 20 and 21. This arrangement of adjuster groups 30 is also found on the inside form group 14 by use of interior adjuster groups 32. The specific structure of these ball and socket type adjusters will be discussed in more detail below.

Figure 3:
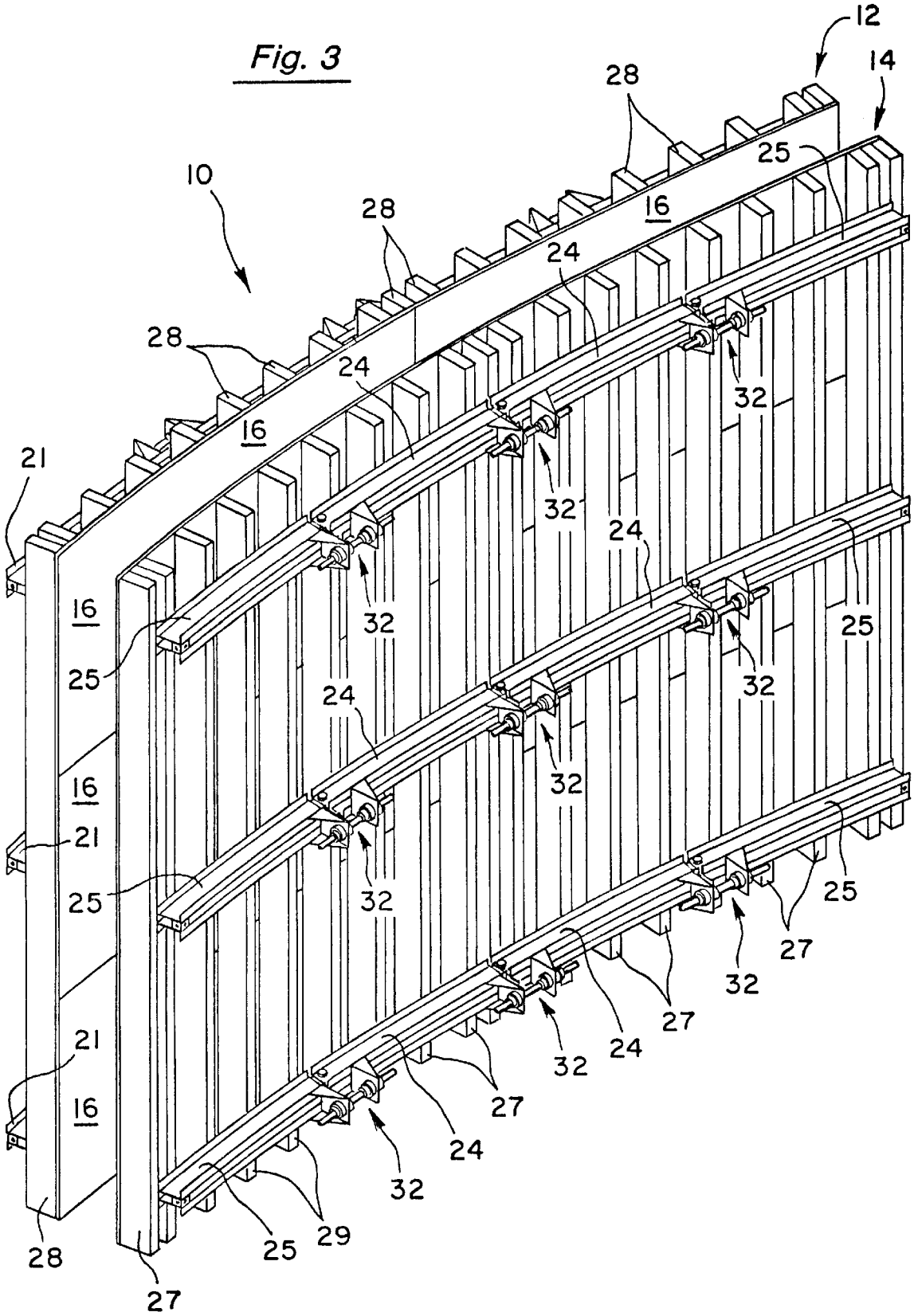
FIG. 3 is another perspective view, as in FIG. 2, but illustrating the use of interior and exterior wood-type strongbacks as opposed to metallic strongbacks.

As illustrated in FIG. 3, the metallic strongbacks shown in FIGS. 1 and 2 may be replaced by interior wood-type strongbacks 27 and exterior wood-type strongbacks 28. Either the wood or metal strongbacks are satisfactory for purposes of constructing a form assembly which can withstand the pressure of a concrete structure which has been poured.

Preferably, the metallic strongbacks are made of 6½" aluminum beams. If the strongbacks are constructed of lumber, they are most preferably made of 2½"×6½" West Coast fir, 4"×6" West Coast fir or southern yellow pine LVL.

Figure 4:
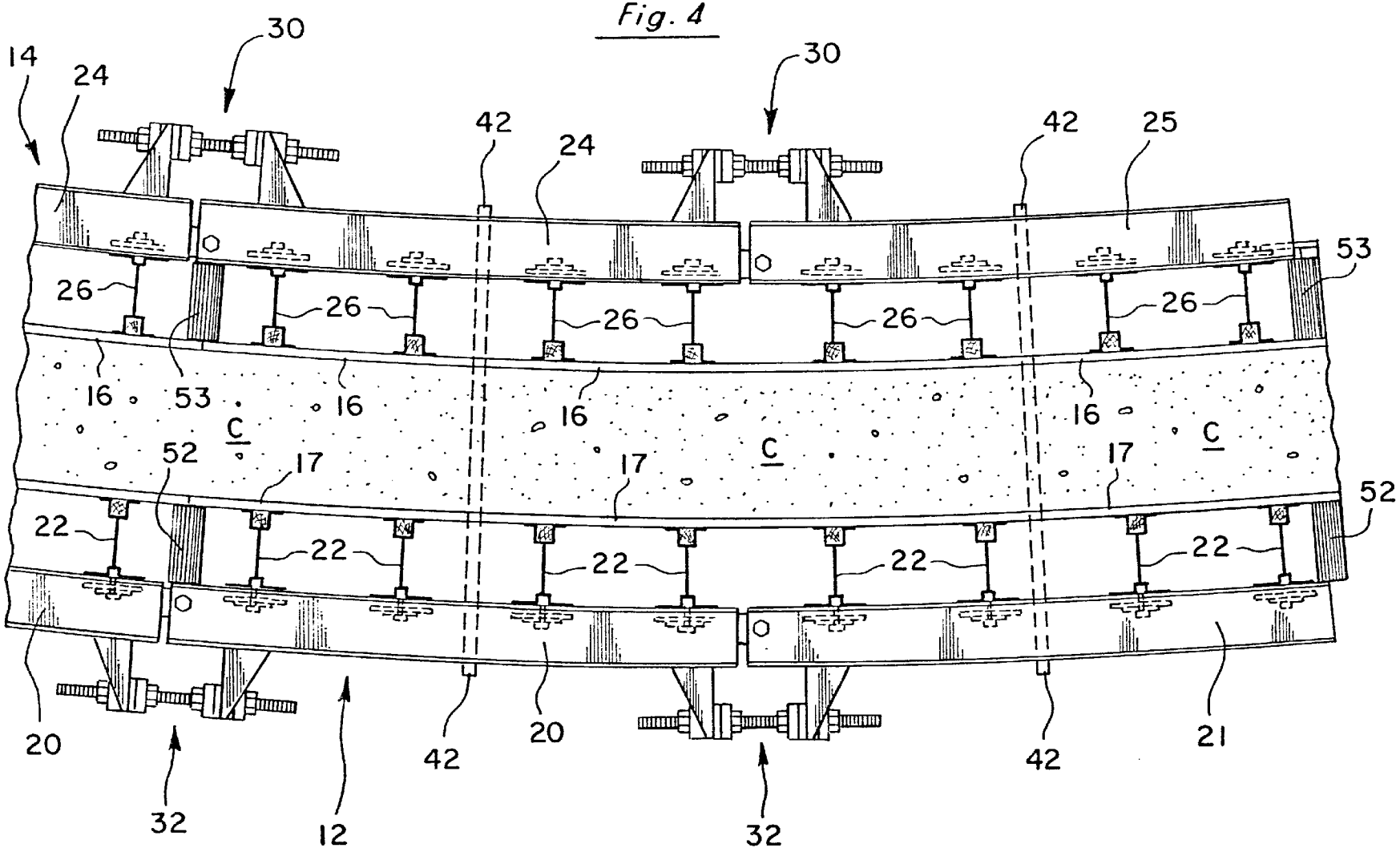
FIG. 4 is a fragmentary plan view of the form assembly of this invention further illustrating some interior structural details of the members making up the form assembly, and further illustrating a material such as concrete placed between the inside and outside form groups.

FIG. 4 is a plan view illustrating concrete which has been poured between the inside and outside form groups with tie wires 42 being used to maintain the inside and outside form groups in a desired spaced relationship. As well understood by those skilled in the art, ties 42 are secured to opposed surfaces of the form groups in order to securely connect the form groups while the concrete cures.

Figures 5, 6, 7, 8, 9:
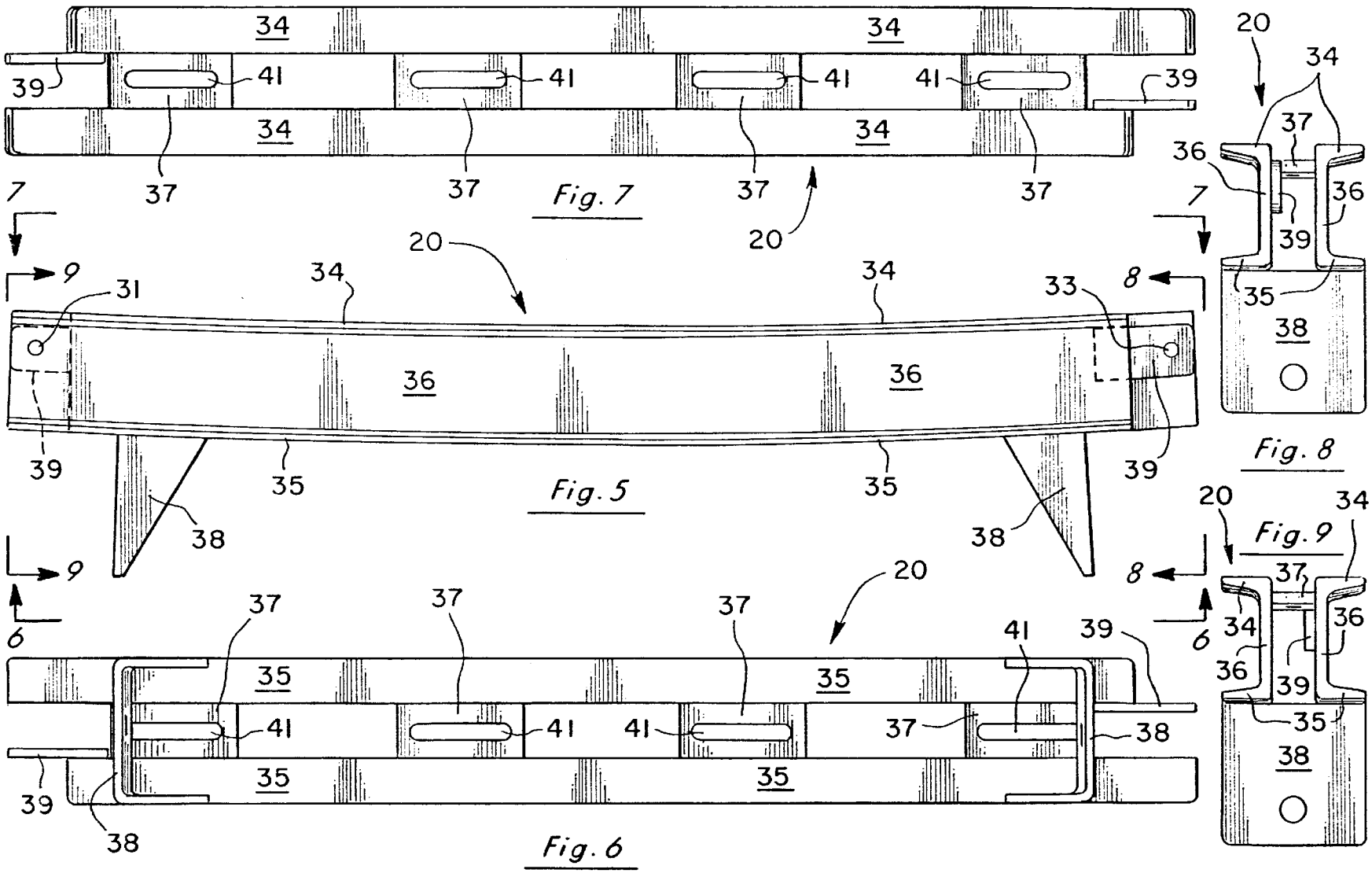
FIG. 5 is a plan view of an exterior double plate waler.
FIG. 6 is an elevation view of the waler of FIG. 5 as viewed from the exterior side of the form assembly.
FIG. 7 is an elevation view of the waler of FIG. 5 viewed from the interior side of the form assembly.
FIG. 8 is a right end view of the waler of FIG. 5.
FIG. 9 is a left end view of the waler of FIG. 5.

FIGS. 5–9 illustrate an exterior double plate waler 20 in detail. As shown best in FIGS. 8 or 9, each of the exterior double plate walers 20 include a pair of inside or interior waler flanges 34 and an opposing pair of exterior or outside waler flanges 35. Flanges 34 and 35 are connected by a pair of parallel spaced webs 36. A plurality of slotted connector plates 37 are positioned adjacent the inside waler flanges 34 and traverse therebetween in order to connect the pair of webs 36. The resulting shape of waler 20 resembles two oppositely faced C channels with a segmented member in the form of the slotted connector plates 37 which are used for mounting the oppositely faced C-type channels. As best seen in FIG. 5, the exterior or outside edges of walers 20 include a pair of triangular adjustment plates which are used for mounting the ball and socket type adjusters 70, as further explained below. A pair of end plates 39 are attached to the opposite ends of the waler and alternating sides of webs 36. These end plates 39 each include an opening 33, and extend parallel with webs 36. Each end of the waler which includes a plate 39 also includes an opening 31 formed on web 36 and which aligns with hole 33. Therefore, as illustrated in FIG. 5, the aligned holes 31 and 33 appear as a single hole or opening. End plates 39 serve to connect adjacent walers to another, as also further discussed below. Each of the slotted connector plates 37 include a slot 41 through which a connector bolt on a strongback extends which enables the walers to accommodate connection of the strongbacks thereto in differing spaced arrangements as more fully discussed below.

Figures 10, 11, 12, 13, 14:
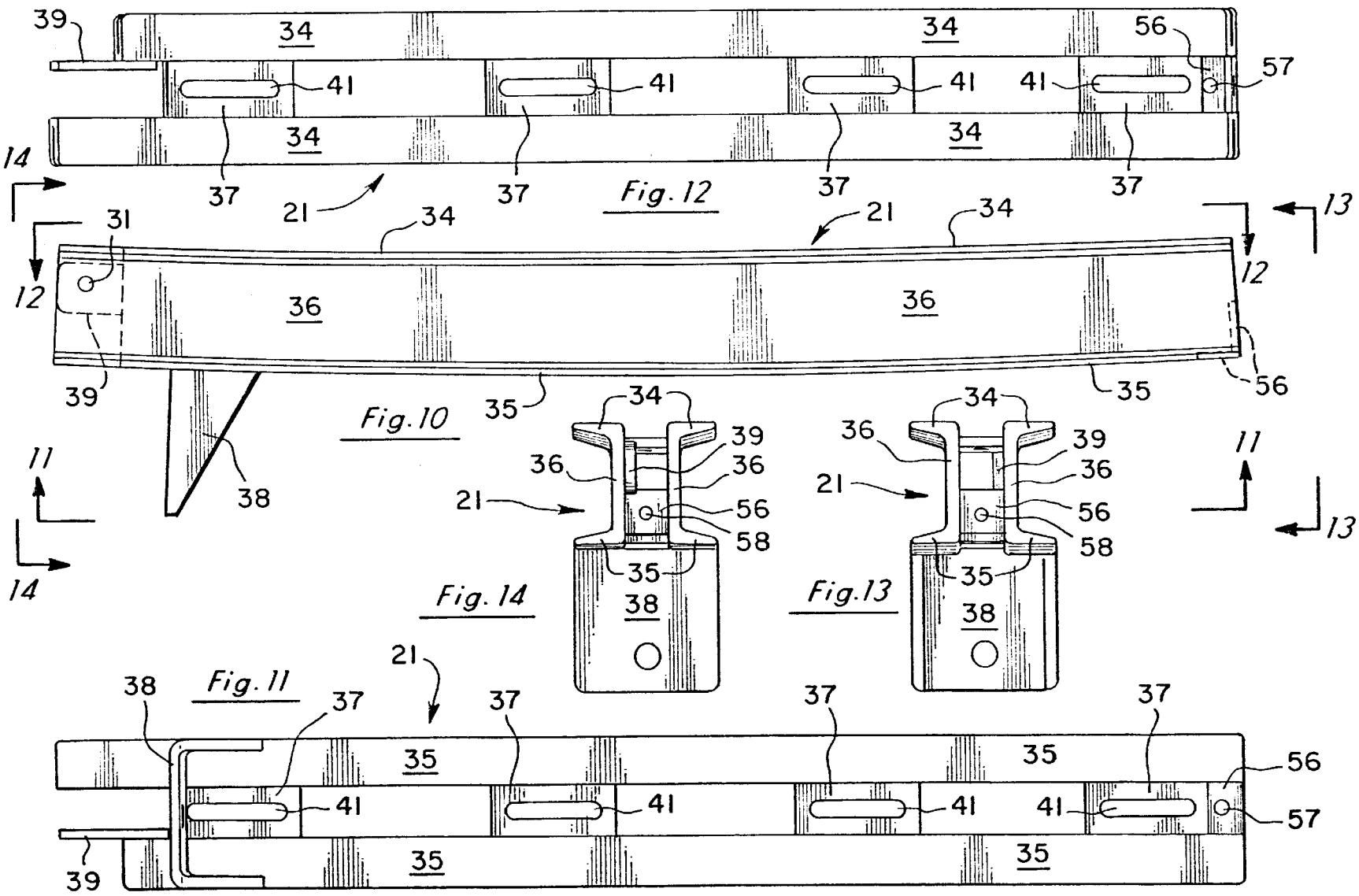
FIG. 10 is a plan view of an exterior single plate waler.
FIG. 11 is an elevation view of the waler of FIG. 10 showing the waler as it appears from the exterior side of the form assembly.
FIG. 12 is an elevation view of the waler of FIG. 10 showing the waler as it appears from the interior side of the outside form group;.
FIG. 13 is a right end view of the waler of FIG. 10.
FIG. 14 is a left end view of the waler of FIG. 10.

FIGS. 10–14 illustrate in greater detail an exterior single plate waler 21, also illustrated in FIG. 1. Exterior single plate waler 21 is identical in arrangement to that of exterior double plate waler 20 with the exceptions that waler 21 includes only one triangular adjustment plate 38, and the end of the waler opposite the end of the waler including the single adjustment plate 38 includes an L-shaped end gusset connector 56 in lieu of an end plate 39. End gusset connector 56 has two flanges at right angles to each other, each with a hole or opening formed thereon. FIG. 12 illustrates opening 57 located in one flange and extending from the interior to the exterior side of the waler. Opening 58, shown in FIGS. 13 and 14, is located in the other flange at the end of waler 21 and is shown as extending lengthwise or longitudinally along the waler 21. The function of the connector 56 will be discussed in more detail below.

Referring back to FIG. 1, walers 21 are positioned at the outside edges or ends of each gang form length. A gang form length is defined by the combination of two or more adjacent attached double plate walers 20 and two single plate walers 21, one of each of the single plate walers connected at opposite ends of the adjacent attached double plate walers. The gang form combination or arrangement is then repeated the desired number of times to achieve the desired curved form for the structure to be formed. For example, enough gang form lengths could be used to create a circular shaped form assembly, or a lesser number of gang form lengths could be used to otherwise produce a concrete structure having a curved surface of a desired length and curvature.

Figures 15, 16, 17, 18, 19:
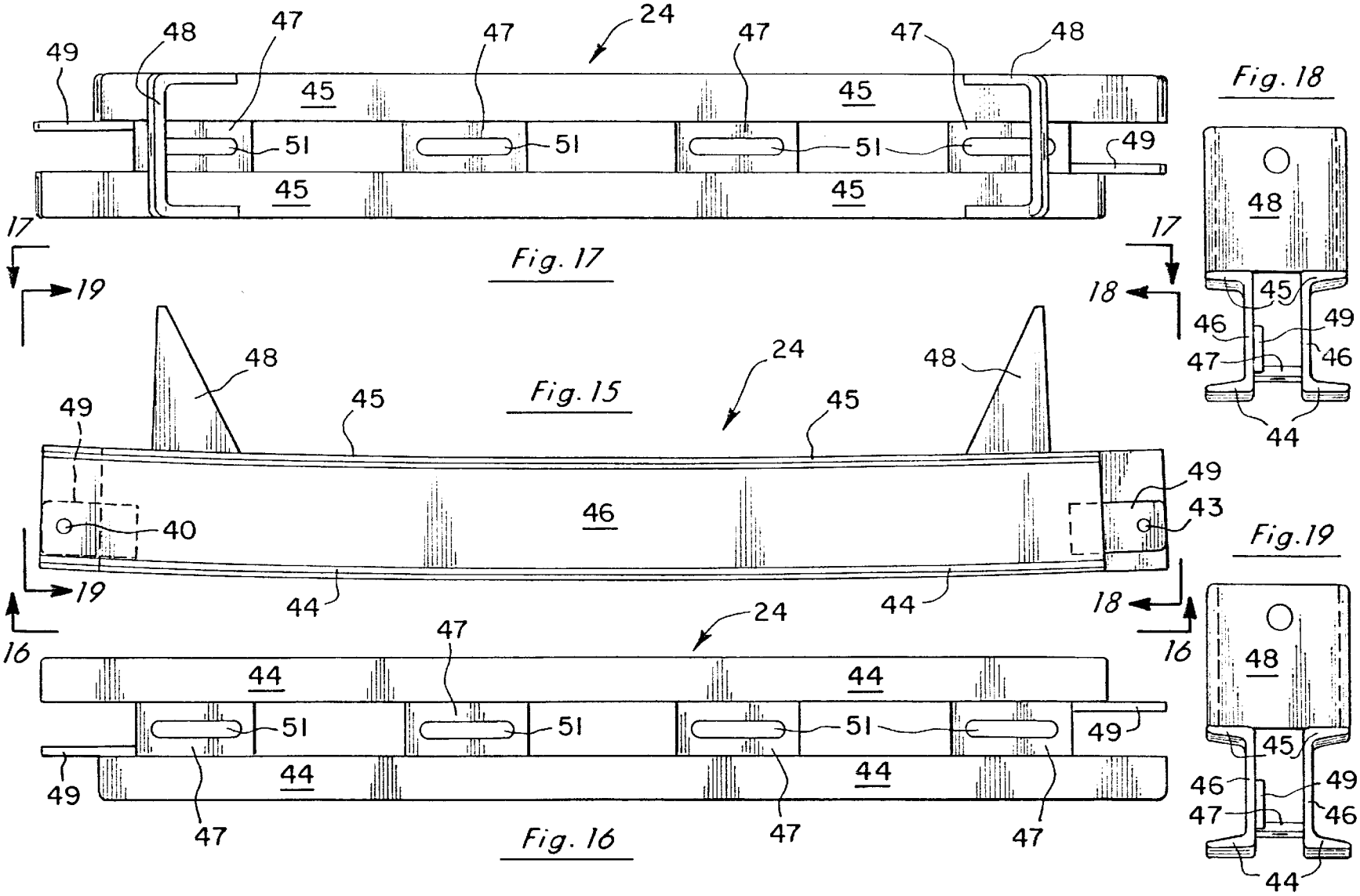
FIG. 15 is a plan view of a double plate interior waler.
FIG. 16 is an elevation view of the waler of FIG. 15 showing the waler as it appears from the exterior side of the inside form group.
FIG. 17 is an elevation view of the waler of FIG. 15 showing the waler as it appears from the interior side of the form assembly.
FIG. 18 is a right end view of the waler of FIG. 15.
FIG. 19 is a left end of the waler of FIG. 15.

FIGS. 15–19 illustrate interior double plate waler 24 in further detail. Waler 24 is identical to waler 20 with the notable exception that it has an opposite curvature in comparison to waler 20. As with waler 20, waler 24 is also defined by a first pair of waler flanges 45 and a second pair of waler flanges 44 that are interconnected by a pair of webs 46. A plurality of slotted connector plates 47 connect the pair of webs 46. A pair of triangular adjustment plates 48 are positioned at opposite ends of the waler and are used to mount the ball and socket type adjuster groups 32, as further explained below. End plates 49 are attached to opposite and alternate ends of the waler and serve to connect adjacent interior walers to one another. Each end plate 49 includes its own hole or opening 43. Each end of the waler which includes a plate 49 also includes an opening 40 formed on web 46 and which aligns with hole 43. Therefore, as illustrated in FIG. 15, the aligned holes 40 and 43 appear as a single hole or opening. Slot 51 is formed in each of the connector plates 47 to provide adjustable positioning of the connecting bolts attached to the strongbacks to facilitate varying the curvature of the form groups so that the forms can be used in repetitive applications to form curved walls having different radiuses.

Interior single plate waler 25 is illustrated in FIGS. 20–24, and is identical to exterior single plate waler 21, with the exception that the curvature of waler 25 is also opposite waler 21. Alternatively, waler 25 can be thought of as having the same curvature as waler 21, but the triangular adjustment plate 48 is placed on the opposite side of the waler. The double plate walers may also be viewed in the same respect. That is, the interior and exterior double plate walers 20 and 24 can be viewed as having the same curvature; however, the triangular adjustment plates being placed on opposite sides thereof.

Figures 20, 21, 22, 23, 24:
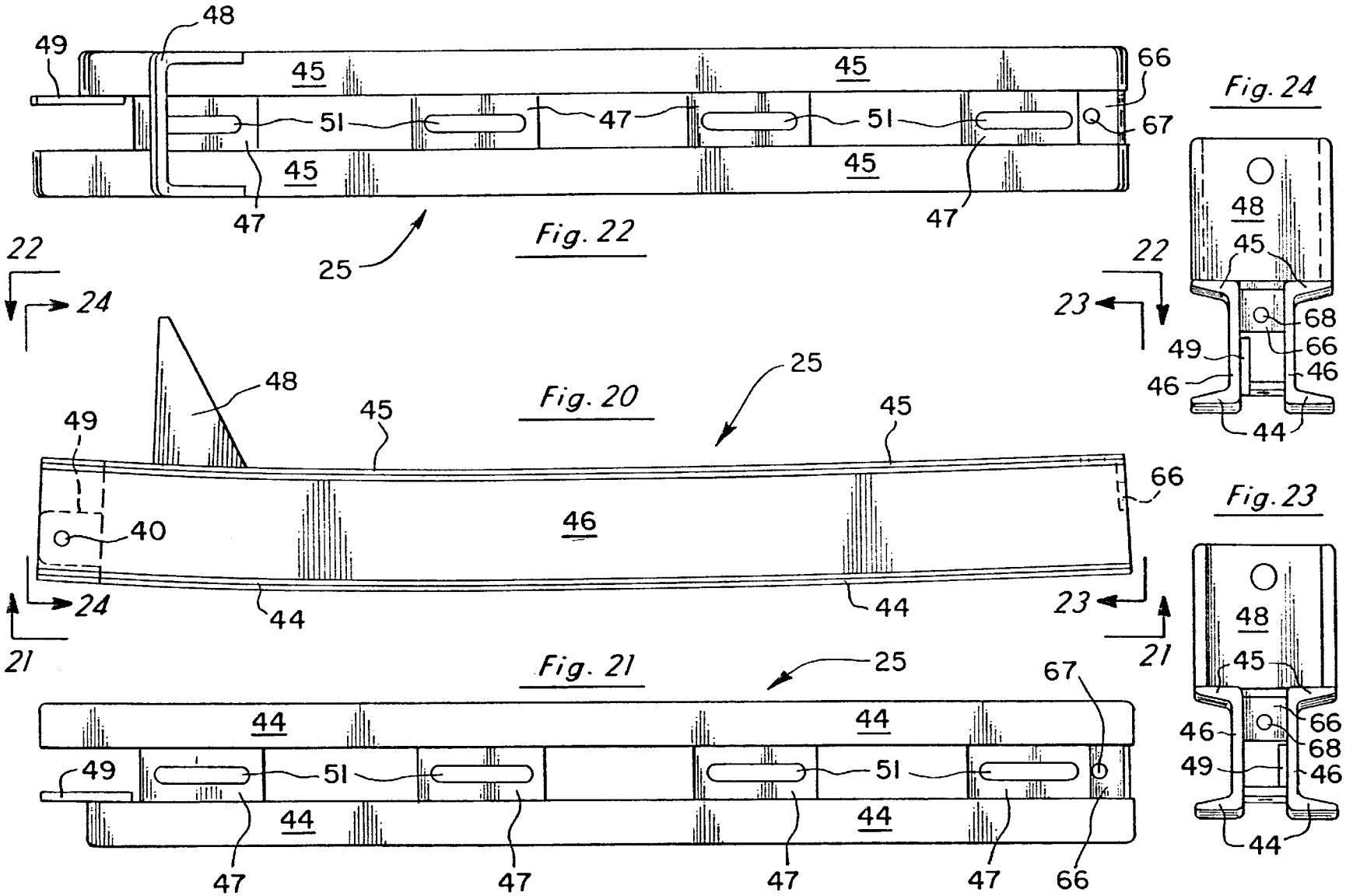
FIG. 20 is a plan view of an interior single plate waler.
FIG. 21 is an elevation view of the waler of FIG. 20 showing the waler as it appears from the exterior side of the inside form group.
FIG. 22 is an elevation view of the waler of FIG. 20 illustrating the waler as it appears from the interior side of the form assembly.
FIG. 23 is a right end view of the waler of FIG. 20.
FIG. 24 is a left end view of the waler of FIG. 20.

Interior single plate waler 25 is used on the outside ends of each of the gang form lengths and, therefore, waler 25 only has one triangular adjustment plate 48. Each of the structural components making up waler 25 have been given the same reference numbers as compared to waler 24. Therefore, this discussion will not be repeated. The only structure which is different between walers 24 and 25 is that waler 25 includes only one triangular adjustment plate 48, and one of the end plates 49 in waler 25 is replaced by L-shaped end gusset connector 66. As shown in FIGS. 21–24, end gusset connector 66 is positioned between and connects to webs 46. Gusset connector 66 includes two flanges, each having an opening or hole formed thereon. Specifically, FIG. 22 illustrates hole or opening 67 which is formed in the flange adjacent to the interior or inside surface of waler 25 and extending from the interior to the exterior side of the waler, while opening or hole 68 is formed in the flange adjacent to the end of gusset connector 66 and extends lengthwise along the waler.

Figure 25:
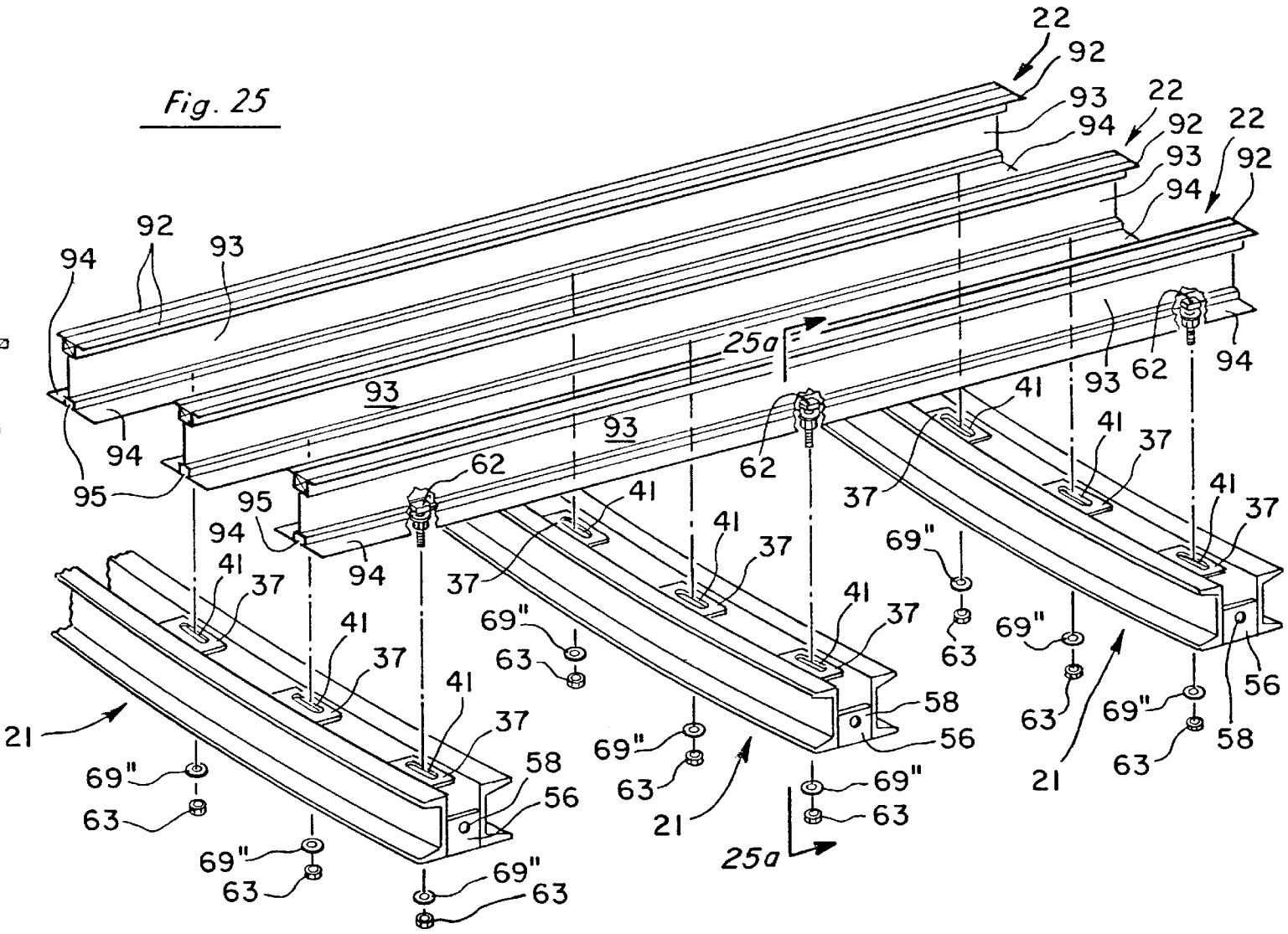
FIG. 25 is an exploded fragmentary perspective view of three exterior single plate walers as they are attached to three corresponding exterior metal-type strongbacks.
Figure 28:
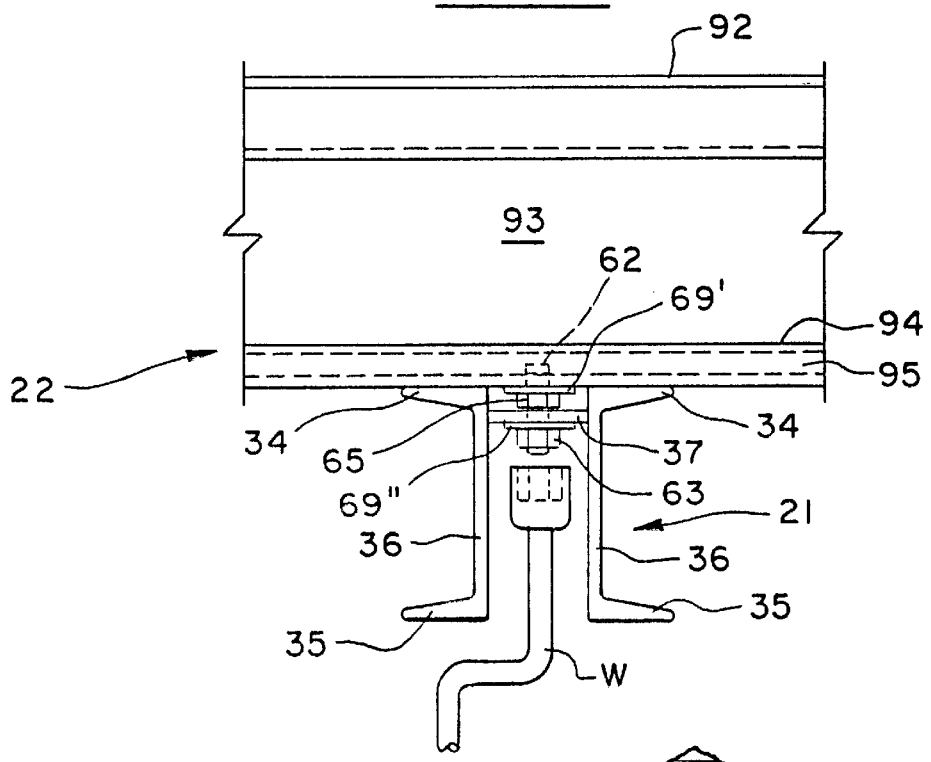
FIG. 28 is an enlarged fragmentary elevation view of the connection between an exterior waler and an exterior strongback.

FIG. 25 illustrates how exterior strongbacks 22 are attached to the exterior single plate walers 21. This method of attachment is identical also for attachment of the exterior strongbacks to the exterior double plate walers 20, as well as the attachment of the interior strongbacks 26 to both the interior double plate and interior single plate walers 24 and 25, respectively. As shown in FIG. 25, a preferred means by which each strongback is connected to a corresponding waler is by a combination of nuts and washers which are secured to a twist bolt. More specifically, a gap or slot 95 may be formed on one side of the exterior strongback 22 so that the gap or slot is just large enough for the body of the bolt 62 to pass therethrough, but the head of the bolt is retained within the gap or slot. Accordingly, bolt 62 is mounted within the gap or slot 95 by sliding the bolt 62 from one of the ends of the strongback into the slot. Once the head of the bolt 62 slides within the gap or slot 95, as also shown in FIG. 28, the first washer 69' and nut 65 are used to secure the bolt 62 to a specified location along the length of gap or slot 95. Plate 37 is set forward of flanges 34 a sufficient distance to provide a recess to receive and accommodate nut 65 and washer 69'. Waler 21 is then positioned adjacent and aligned with each of the bolts 62. Aligned slots 41 of connector plates 37 are placed over the exposed ends of bolts 62. Another washer 69" and nut 63 are then used to securely fasten the strongback 22 to the waler 21. However, before nut 63 is secured, bolts 62 are allowed to be adjustably positioned along the respective slots 41 to set the desired radius for the forms. Subsequently, nuts 63 are tightened to hold the form group in the desired curvature.

To subsequently adjust the forms to a different radius is quite simple. Nuts 63 merely need to be loosened during the change in the angular relationship of the adjacent form by the adjustment members, as previously described, so that bolts 62 are free to move along slots 51. Conveniently, bolts 62 are maintained in proper vertical alignment by nuts 65 which are still secured. Once the new curvature is established, nuts 63 can be retightened. Thus, no loose clips are required and no inadvertent vertical misalignment of bolts 62 along the strongbacks can occur.

Although a particular arrangement is shown for the specific hardware used to attach the strongback 22 to the corresponding waler 21, it will be understood by those skilled in the art that other combinations of hardware may be used to achieve the connection.

Figure 26:
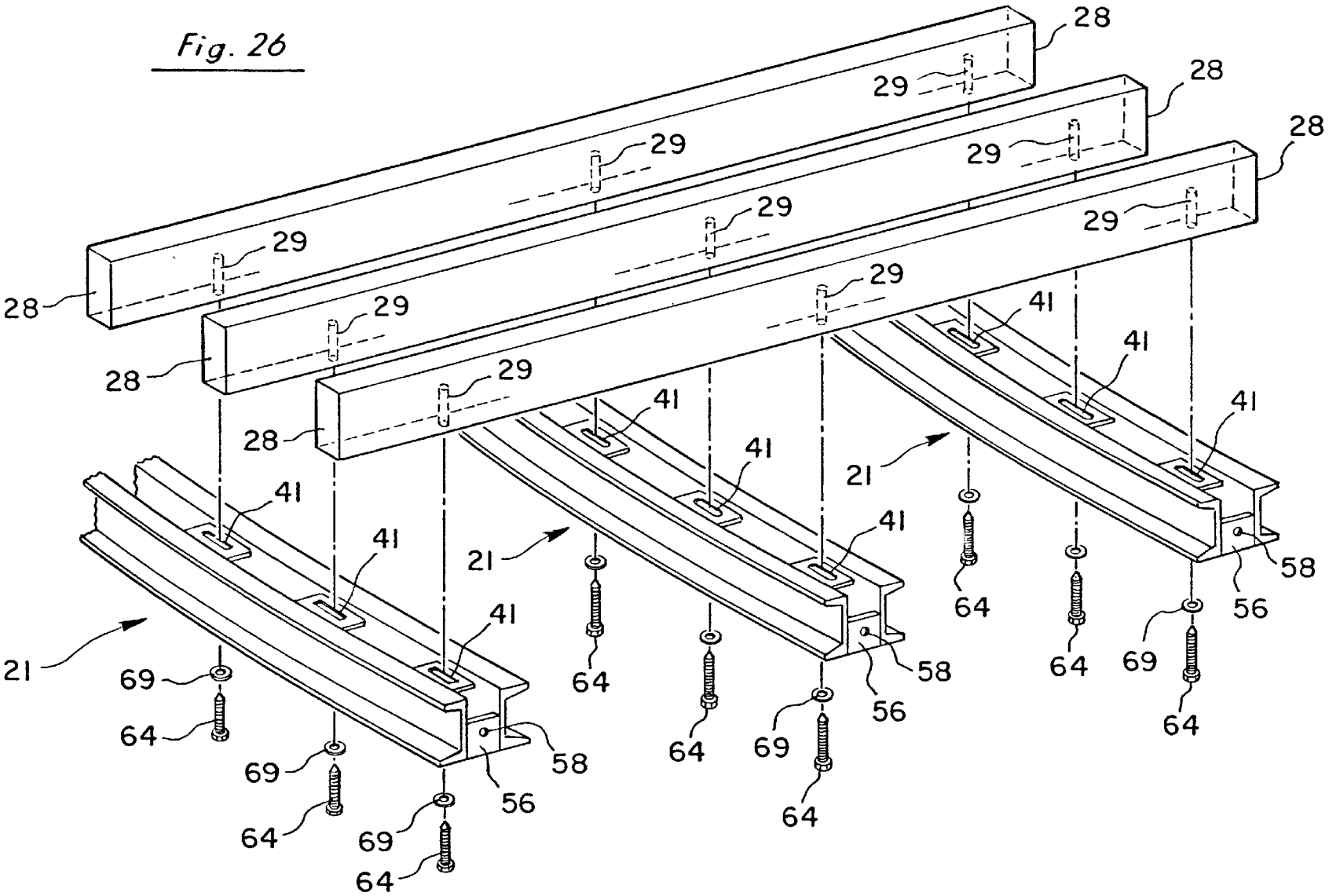
FIG. 26 is another exploded fragmentary perspective view of three exterior single plate walers as they are attached to three corresponding exterior wood-type strongbacks.

FIG. 26 illustrates the attachment of the wooden type strongbacks 28 to their corresponding walers 21. When wooden strongbacks are used, it is preferred to drill a hole or bore 29 in the strongbacks which then receive a corresponding lag screw 64. Screw 64 is inserted through washer 69 and then through slot 41 prior to entering hole 29. Prior to completely tightening screws 64, the desired radius of the form group is set wherein screws 64 are free to move along slots 41. After the curvature is set, the screws are tightened to hold the form group in the desired fixed position. For the next setup, it is only necessary to slightly loosen screws 64 so that they can slide along slots 41 for positioning to a new radius. Since the screws are still retained in bores 29, the vertical position of the walers to the strongbacks is maintained. As with the particular arrangement of hardware shown in FIG. 25, it will also be understood that other hardware combinations may be used to connect wooden type strongbacks to their corresponding walers. Additionally, the method of attachment illustrated in FIG. 26 with respect to exterior wooden type strongbacks 28 and their attachment to exterior strongbacks 21 is also equally applicable to the attachment of all interior or exterior wooden type strongbacks to their corresponding walers.

Figures 27, 27A:
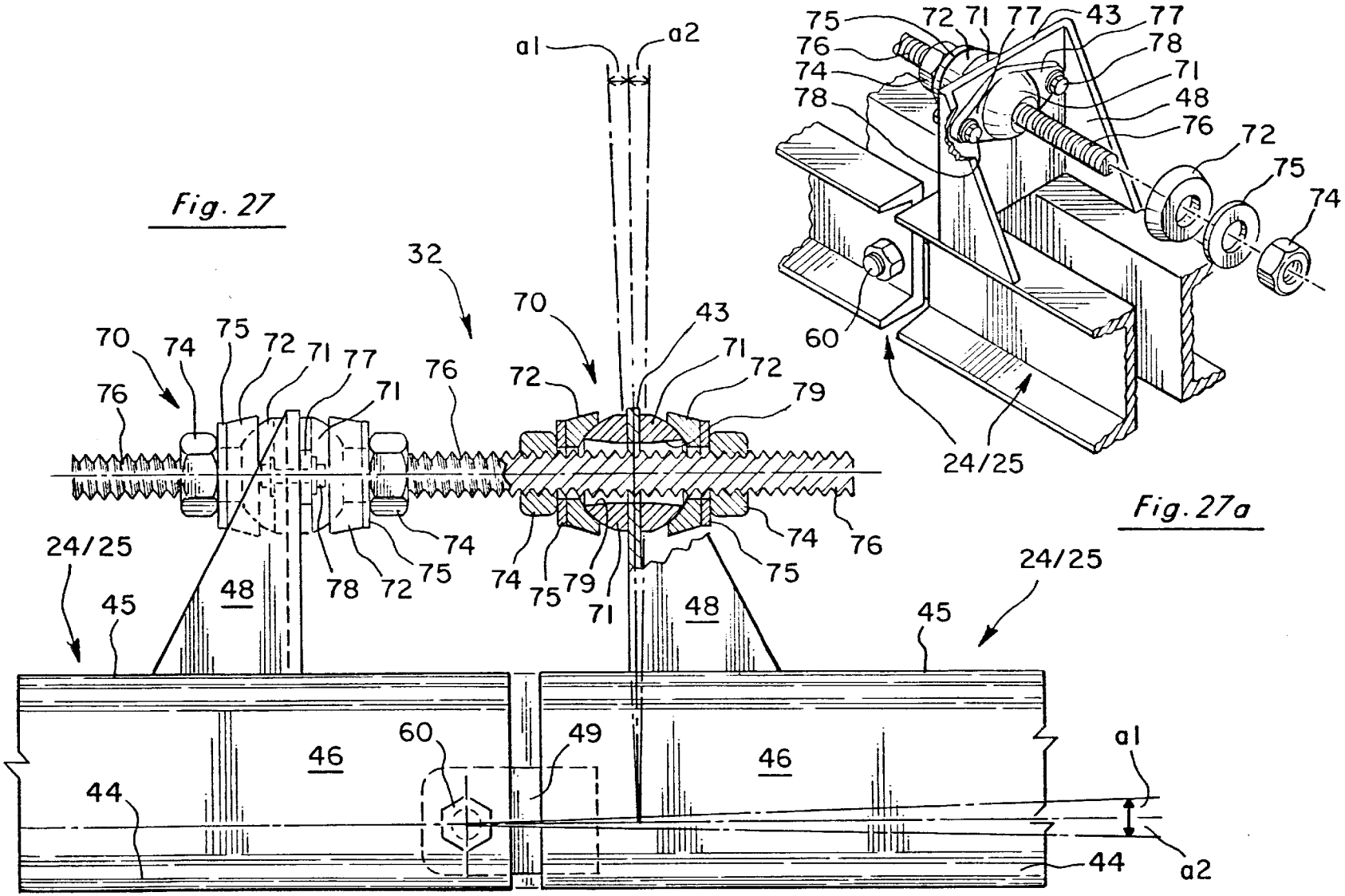
FIG. 27 is an enlarged fragmentary plan view of two interior walers and a pair of corresponding interior ball and socket type adjusters, one of the interior ball and socket type adjusters broken away to illustrate some of the structural details therein.
FIG. 27*a* is an enlarged fragmentary, partially exploded, perspective view of the adjusters of FIG. 27.
Figure 31A:
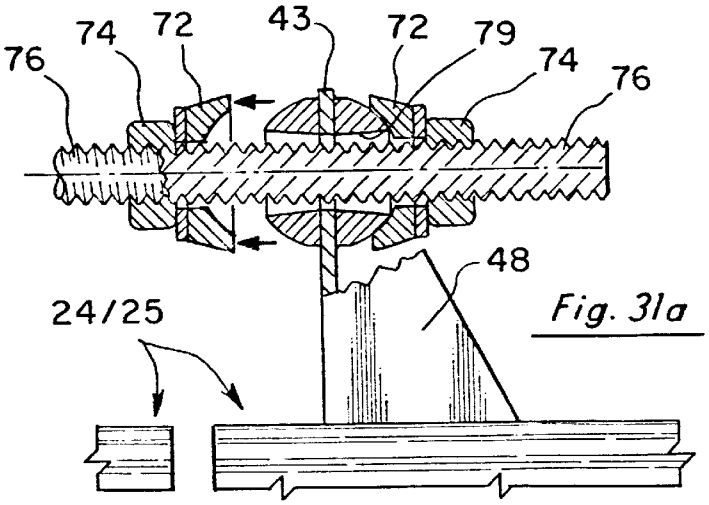
FIG. 31*a* is another fragmentary plan view, as shown in FIGS. 30*a* and 30*b*, illustrating the left side socket and nut being unscrewed from contact with the corresponding left side ball half.
Figure 31B:
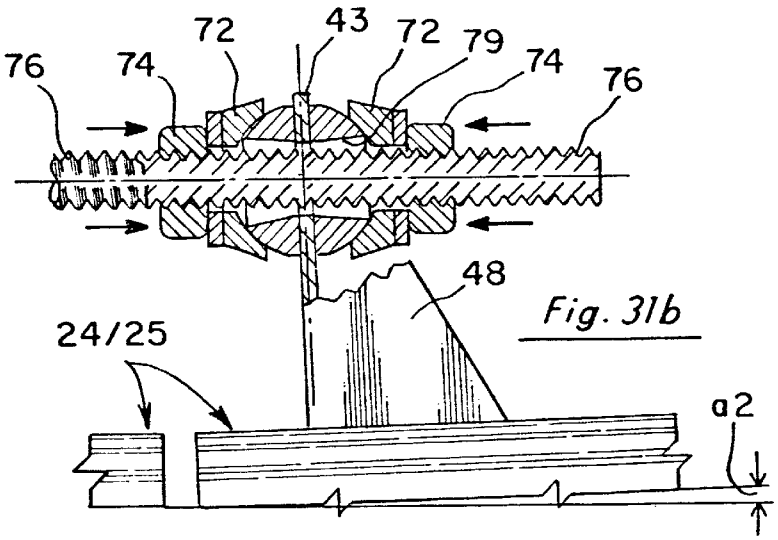
FIG. 31*b* is yet another fragmentary plan view of FIG. 31*a* illustrating the waler being pivoted to an angle a2 and resulting in the corresponding gang form length having a smaller radius or greater curvature.
Figures 32A, 32B, 33A, 33B:
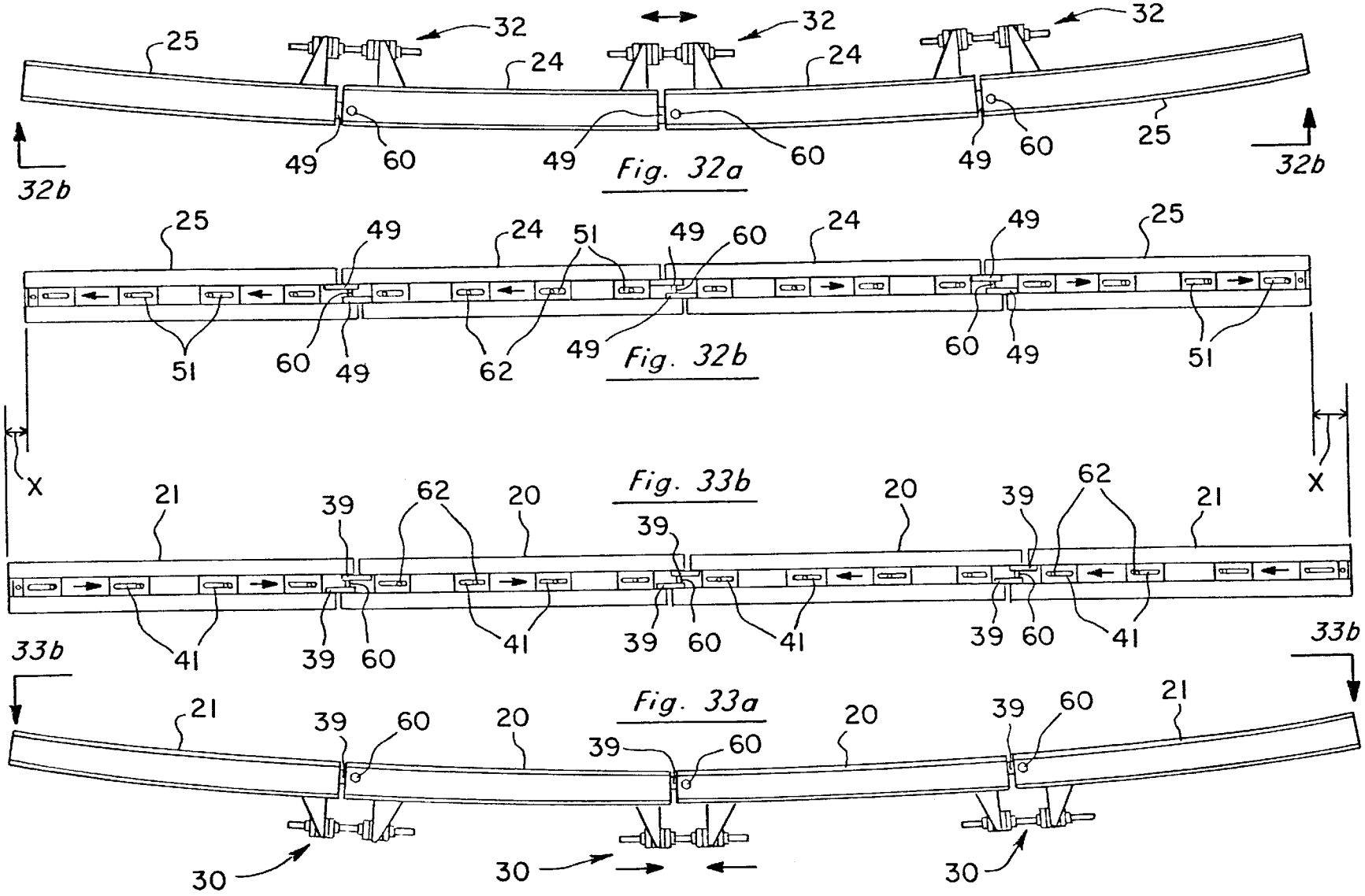
FIG. 32*a* is a plan view of four interior walers which have been set to a predetermined curvature or radius.
FIG. 32*b* is an elevation view of the interior walers of FIG. 32*a* as seen from the exterior side of the inside form group, and specifically illustrating the adjustable placement of the twist bolts along corresponding slots of the slotted connector plates, said twist bolts being the structure by which the strongbacks are connected to the walers, said placement of the twist bolts along the slots enabling the strongbacks to be positioned uniformly along the walers, but permitting adjustable spacing thereof based upon the specific curvature or radius of the waler member group.
FIG. 33*a* is a plan view of four exterior walers having a predetermined curvature or radius.
FIG. 33*b* is an elevation view of the walers of FIG. 33*a* as seen from the interior side of the outside form group, and specifically illustrating the twist bolt arrangement in each of the corresponding slots of the slotted connector plates, said spacing of the twist bolts within the slots enabling the vertical strongbacks to be spaced apart in a uniform manner despite the enlarged radius of the group of exterior walers in comparison to the radius of the interior walers of FIG. 32*a*.

FIG. 27 illustrates the use of a pair of ball and socket type adjusters 70 in adjuster group 32, and the attachment between two interior walers 24/25. As shown, the walers are placed end to end such that the adjacent end plates 49 have their corresponding openings 43 aligned with one another to receive therethrough pivot pin 60. This arrangement of the end to end walers is also illustrated in FIGS. 30–33. In FIGS. 33*a* and 33*b*, pivot pin 60 is also seen as the means of attachment between end plates 39; end plates 39 being the equivalent functioning structure as end plates 49. As further shown in FIG. 27*a*, pivot pin 60 also may traverse through openings 31 and 40 which each align with openings 33 and 43.

The construction and operation of the ball and socket type adjusters will now be discussed. Referring first to FIG. 27, interior adjuster group 32 includes a receiving member in the form of a pair of ball and socket type adjusters 70, each ball and socket type adjuster 70 defined by a split ball 71 which includes an interior channel or passageway 79 and which receives a stabilizing member in the form of threaded rod 76 therethrough. As shown in FIG. 27*a*, flanges 77 are integral with each ball half 71. Each half of the ball 71 is secured to vertical portion 43 of adjustment plate 48 by means of bolts 78 which are placed through bores or holes in flanges 77.

Figure 30A:
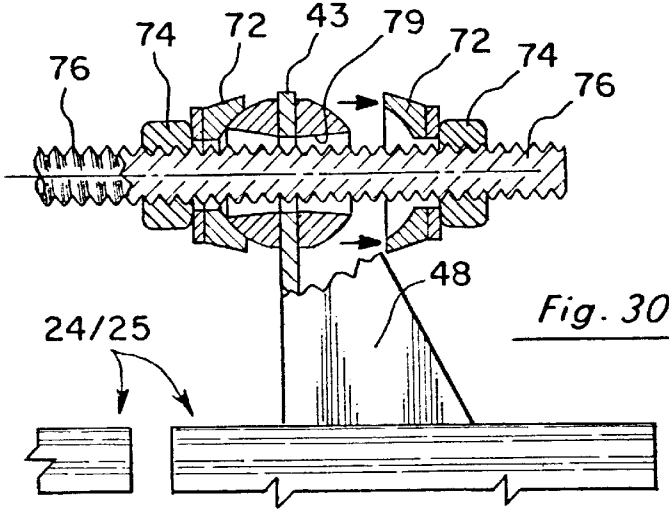
FIG. 30*a* is a fragmentary plan view, similar to FIG. 27, showing the right side socket and nut unscrewed from contact with the right side ball half so that the waler may be pivoted resulting in an adjustment to change the curvature of the particular gang form.

The adjustment of the radius of a gang form length or of a particular group of walers will now be described with respect to FIGS. 27–27*a* and FIGS. 30–31. As best seen in FIG. 27, a gap or space exists between threaded rod 76 and the inner cylindrical surface defining channel 79. This gap or space between the rod and the inner surface defining the channel 79 enables the desired waler to be rotated a certain degree about pivot pin 60 without the rod 76 making contact with the inner surface defining the channel 79. Assuming that FIGS. 27, 30 and 31 illustrate an interior waler 24 or 25, the radius of the group of walers or gang form length may be made smaller by rotating the desired waler so that it departs from its original line of extension or axis by angle a1. As shown in FIG. 27, angle a1 is measured either by the rotation of the waler from its horizontally appearing position in FIG. 27, or by the change in the vertical angle of vertical portion 43. In either case, a smaller diameter results by rotation of the waler to angle a1. As the waler 24/25 is rotated about pivot pin 60, the threaded rod 76 will traverse through channel 79 also at an angle equal to a1. Prior to rotating waler 24/25, as shown in FIG. 30*a*, the right side nut 74 and socket 72 are screwed away from right side ball half 71. Optionally, one or more spacers or washers 75 can be used between nuts 74 and sockets 72. The waler is then rotated by tightening left side socket 72 and nut 74. Left side socket 72 and nut 74 are tightened enough to create the rotated position of the waler defined by angle a1. The right side socket 72 and nut 74 are then re-tightened to stabilize the waler in the rotated position. The procedure for reducing the curvature or creating a larger radius for an interior waler is shown in FIGS. 31*a* and 31*b*. In this instance, the left side nut 74 and socket 72 are first loosened and placed away from contact with the left side ball half 71. The waler is then rotated to an angle a2 by tightening right side socket 72 and nut 74, the angle a2 defining the desired enlargement of the curve or radius for the corresponding waler. The left side nut 74 and socket 72 are then re-tightened against the left side ball half 71 to stabilize the waler in its rotated position. This same procedure for enlarging or reducing the radius or curvature of walers 24/25 can be achieved by manipulating the ball and socket type adjuster 70 appearing on the left side of FIG. 27. The ball and socket arrangement just described maintains the alignment of rod 76 with nuts 74 so that the nuts do not bind up as the radius is changed.

Depending upon the exact curved shape desired in the concrete structure to be formed, or the desired radius of the concrete structure to be formed, each of the ball and socket type adjusters 70 may be adjusted so that the corresponding walers can be rotated to the desired positions. Because of the rounded shape of each ball half 71 and socket 72, the sockets can engage and hold their corresponding ball halves as a waler is rotated through differing angles. Thus, the adjuster groups 30 and 32 are appropriately termed "ball and socket" type adjusters. The limit of rotation for each of the walers to create the desired curvature or radius is limited by the degree to which threaded rod 76 can be skewed within channel 79 without making contact with the inner surfaces defining the channel. As shown in FIGS. 27, 30 and 31, the gap between the threaded rod 76 and channel 79 is relatively small. However, it will be understood by those skilled in the art that the channel 79 can be enlarged or reduced to the specific size which enables each of the walers to be rotated the desired amount.

One convenient method by which the overall curvature or radius of the end to end walers can be adjusted is to provide a template which is representative of the desired curved shape or radii of the concrete structure to be formed. For example, the particular shape of the concrete shape to be formed would be outlined on the ground by means of a marker or the like. Then, the group of end to end walers could be placed on the line drawn on the ground. Each of the waler members are then pivoted to closely conform to the particular shape drawn. During this procedure, nuts 63 will be loosely threaded on their respective bolts 64 to permit the bolts 64 to move along slots 47 until the waler members are in the desired radial position. This procedure could be repeated for each group of end to end walers, and each gang form length. Once the waler configuration is set, the nuts 73 are tightened so that the strongbacks are securely attached to the walers at a desired spacing from one another. If the same curvature is required in the construction of a subsequent structure, the rods 76 can be marked to define the point(s) at which the nuts 74 are to be positioned. Thus, the rods can be used as point of reference to define the particular angular relationship between the corresponding walers.

Although FIGS. 27, 30 and 31 illustrate a plurality of interior adjusters and walers, it will be understood that the manipulation of each of the exterior adjusters and walers is identical. Therefore, the creation of a desired curve or radius with the exterior walers is achieved in the same fashion as that of the interior walers discussed above.

Figure 25A:
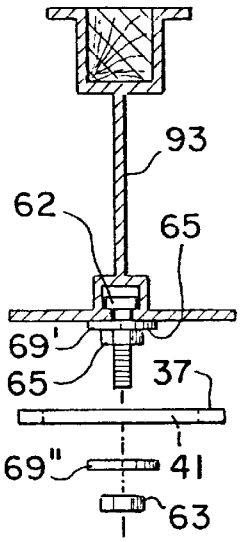
FIG. 25*a* is an enlarged vertical section taken along line 25*a*–25*a* of FIG. 25 further illustrating the connection between a waler and a strongback of FIG. 25.

FIGS. 25 and 25*a* further illustrate the connection between a waler and its corresponding strongback. As shown, strongback 22 attaches to waler 21 by means of twist bolt 62 which is positioned within gap 95. The shape of a metal-type strongback can best be described as an I-beam shaped member which includes a central web 93 which has attached thereto at opposite ends flanges 92 and 94. The gap 95 may be formed adjacent flange 94 and/or flange 92. As shown in FIG. 28, a wrench W may be used to secure nut 63 to the free end of bolt 62 which ultimately secures the waler 21 to strongback 22.

Figure 29:
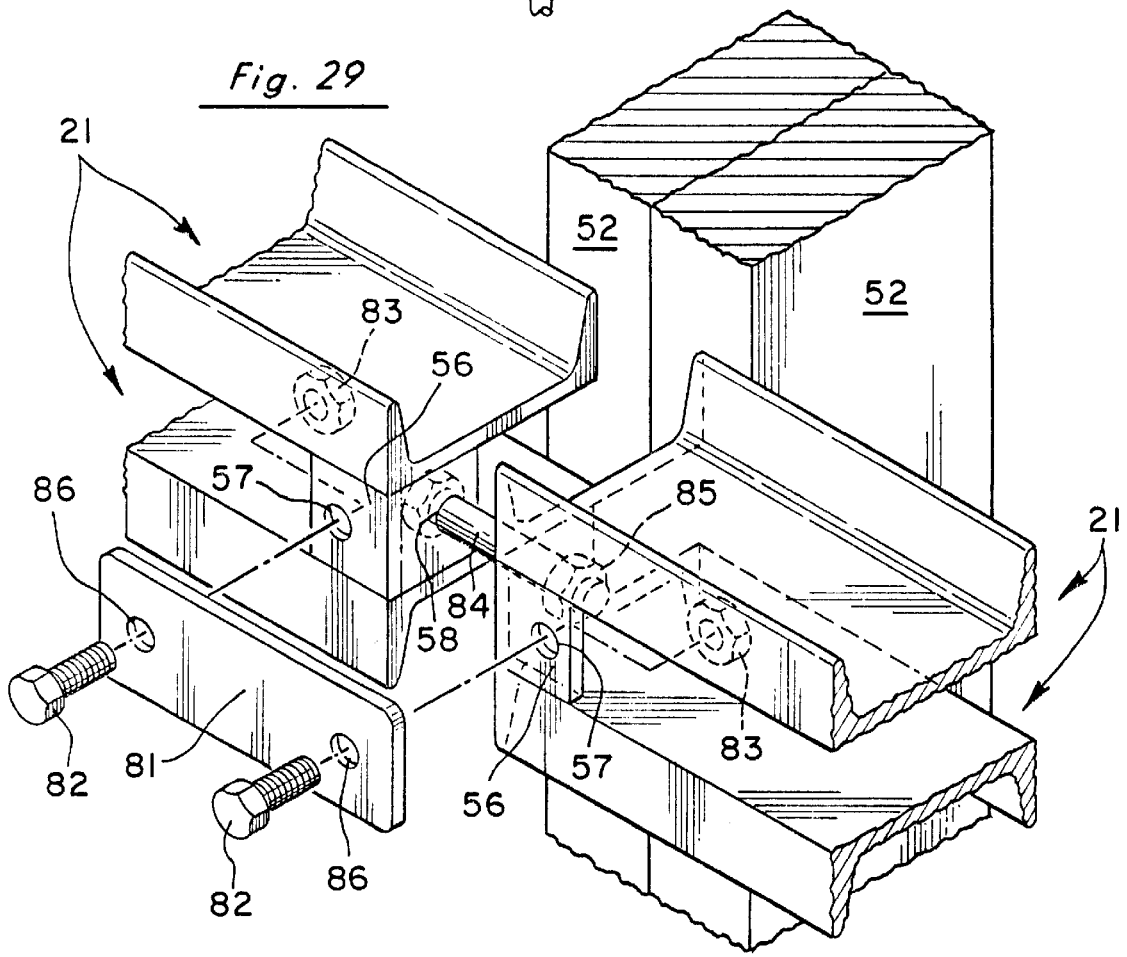
FIG. 29 is an enlarged fragmentary exploded perspective view of the connection between adjacent exterior walers of adjacent gang form lengths.

FIG. 29 illustrates the method by which gang form lengths can be attached to one another in order to provide a concrete structure having the desired length. Each of the single plate walers include an L-shaped end gusset connector formed on the end of the waler opposite the end which includes the end plate. For example, as shown in FIGS. 10–14, exterior single plate waler 21 includes end gusset connector 56 having two flanges at right angles to each other so that the openings or holes are placed 90° with respect to one another. Specifically, opening or hole 57 is formed on the exterior side of gusset connector 56 and opening or hole 58 is formed on the end of gusset connector 56. Similarly, as shown in FIGS. 20–24, interior single plate waler 25 includes L-shaped end gusset connector 66 positioned at the end opposite the end of the waler which includes end plate 49. Gusset connector 66 has one flange which includes hole 67 formed in the second flange on the interior side of waler 25 while opening or hole 68 is formed in the second flange on the end of waler 25. Referring back to FIG. 29, each gang form length may terminate on both sides with a gang form member which may be constructed of lumber. As shown in FIG. 29 and FIGS. 1 and 2, an exterior gang form end 52 is a piece of lumber which is positioned adjacent the most outside vertical strongback. Additionally, such gang form ends may be interspersed among each gang form, for example, between those vertical strongbacks where the exterior ball and socket type adjusters are found. As shown in FIG. 3, the gang form ends 52 are simply the same type of lumber that is used as the wooden type strongbacks 26 and 28. Referring back to FIG. 29, once the gang forms are placed end to end with one another, a connector plate 81 is aligned with holes 57, and a pair of bolts 82 are inserted through holes 86 in the connector plate 81 and through holes 57. Nuts 83 may then be used to securely fasten the bolts 82. Similarly, when the gang forms are placed end to end with one another, holes 58 align with one another so that a bolt 84 may be passed therethrough and is secured between the gang forms by nut 85.

Figure 30B:
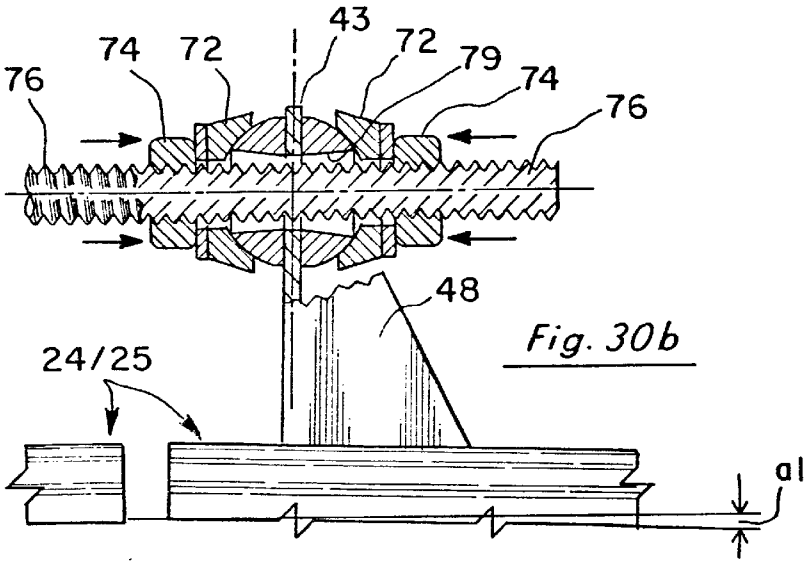
FIG. 30*b* is another fragmentary plan view, as shown in FIG. 30*a*, after the waler has been pivoted or rotated at an angle a1 and resulting in the corresponding gang form length having a larger radius or less curvature.

FIGS. 32*a* and 32*b* illustrate a gang form length defined by a plurality of end to end interior walers 24 and 25. FIG. 30*b* specifically shows the connection of the walers wherein the twist bolts 62 can be placed at a desired location along the lengths of slots 51 in order to properly space each of the strongbacks for the desired wall radius.

FIGS. 33*a* and 33*b* also illustrate the arrangement of a plurality of exterior walers connected to one another to form a desired gang form length. The greater curvature of the gang form in FIG. 32*a* when compared to the gang form length of FIG. 33*a* results in a gang form length difference defined by distance X on each end of the gang forms. It can be observed in a comparison between FIGS. 32*b* and 33*b* that twist bolts 62 are placed within slots 41 and 51 at different locations depending upon the curvature of the particular gang form.

By the foregoing, it is apparent that the adjustable radius form assembly of this invention is capable of creating curved forms which can accommodate wide ranges of radii, yet provide a smooth or even transition between the gang forms in order to minimize any inconsistencies in the creation of a smooth or uniform curved shape. Depending upon the type of curve to be formed by the members of the form assembly, the lengths of the walers can also be adjusted as necessary. For example, if it is required that the curvature of the concrete structure to be formed be extremely precise, the waler lengths could be reduced so that the ball and socket type adjusters could accommodate very precise curvature changes. On the other hand, if such precision is not required in creating the concrete structure, then the waler lengths could be increased so that a larger variance occurs in the curve formed by the adjustment of the ball and socket type adjusters.

Alternatively, depending upon the type of curved structure to be constructed, the walers can be pre-rolled to differing curvatures and then any changes in that curvature are then modified by the use of the ball and socket type adjusters. For example, if a sharper or more severe curve is to be encountered in the construction of a particular group of concrete structures, then the walers can be pre-rolled such that they have a more severe curve. On the other hand, if the group of concrete structures require a less curved shape, then the walers can be pre-rolled to have a less curved shape to accommodate the same.

Although the figures illustrate groups of three horizontally extending walers used in the construction of the form assembly, it will be understood that the number of waler groups can be increased or decreased depending upon the strength of requirements of the form assembly. These requirements are affected by a number of factors such as the height of the concrete structure to be formed as well as the thickness of the concrete structure. Additionally, the spacing of the vertical strongbacks is dictated by the specific strength requirements of the form assembly. It will, therefore, be understood that the spacing between the vertical strongbacks can also be adjusted as necessary.

This invention has been described with respect to a particular embodiment thereof, but it will be understood that other changes or modifications may be made to this preferred embodiment, and which do not depart from the intended scope of the claims herein.

What is claimed is:

1. An adjustable radius form assembly for use in the construction of structures having curved shapes, said form assembly comprising:

at least two walers having adjacent ends connected together at a connection at said adjacent ends thereof, said walers being pivotable with respect to one another at said connection; and at least one adjuster connected between said at least two walers, said adjuster including a stabilizing member and at least one receiving member in the form of at least one ball-shaped member for receiving said stabilizing member therethrough, said adjuster further including at least one securing member in the form of at least one socket member for securing said receiving member at a desired position along said stabilizing member, said desired position defining an angular relationship of rotation between said at least two walers.

2. An assembly, as claimed in claim 1, further including:

a plurality of strongbacks attached perpendicularly to said at least two walers, said strongbacks being spaced from one another a desired distance along said at least two walers.

3. An assembly, as claimed in claim 1, wherein:

said at least one ball-shaped member has a channel formed therethrough, said channel being a size which limits the amount of rotation of one waler with respect to its adjacent waler by constraining the range of movement of said stabilizing member therein.

4. An assembly, as claimed in claim 1, wherein:

said at least one socket member is in releasable engagement with said at least one ball-shaped member.

5. A form assembly, as claimed in claim 1, wherein said at least one adjuster includes two adjusters, one of said two adjusters being connected to one of said at least two walers, and the other of said two adjusters being connected to another of the said at least two walers, each of said two adjusters being adjustable to place said at least two walers in said angular relationship.

6. A form assembly, as claimed in claim 1, wherein:

said at least two walers have a pre-rolled curvature.

7. A form assembly, as claimed in claim 1, wherein said form assembly further includes:

a pair of end plates extending longitudinally from a corresponding one of each of said adjacent ends; and a pin interconnecting said end plates at said connection, said end plates extending an amount which enables said at least two walers to be pivotable with respect to one another without interference.

8. An assembly, as claimed in claim 2, further including:

at least one connector extending from each of said strongbacks;

at least one connector plate including a slot, one each of said plurality of strongbacks being connected to a corresponding waler by said connector extending through said connector plate wherein said strongback may be selectively spaced along said waler by movement of said connector within said slot.

9. A form assembly, as claimed in claim 8, wherein said at least one connector is threaded, further including:

means for holding said connector in a fixed position along each of said plurality of strongbacks; and a first fastener on said connector for releasably securing said waler to said at least one of said plurality of strongbacks.

10. A form assembly, as claimed in claim 9, wherein:

said holding means is a bore in each of said plurality of strongbacks.

11. A form assembly, as claimed in claim 9, wherein at least one of said plurality of strongbacks further includes:

a gap formed along a length thereof; and wherein said at least one of said plurality of strongbacks is attached to a corresponding waler by said connector at a desired position along said gap.

12. A form assembly, as claimed in claim 9, wherein:

said holding means is a second fastener on said connector for holding said corresponding waler against said at least one of said plurality of strongbacks.

13. A form assembly, as claimed in claim 5, wherein said pair of walers each include:

an adjustment plate for mounting a corresponding adjuster thereon, said adjustment plate including an opening for receiving said stabilizing member therethrough.

14. An assembly, as claimed in claim 5, further including:

an adjustment plate at each of said adjacent ends and extending laterally therefrom, each said adjustment plate having an end to which one of said respective two adjusters are attached.

15. An adjustable radius form assembly for use in the construction of curved structures, said form assembly comprising:

at least two walers having adjacent ends connected together at a connection at said adjacent ends thereof and being pivotable with respect to one another at said connection;

an adjuster group interconnected between and spaced laterally from said walers, said adjuster group including a first adjuster attached to one of said walers, and a second adjuster connected to another of said walers, said first and second adjusters each having a channel formed therethrough; and a stabilizing member having a length, said stabilizing member inserted through said channels of said first and second adjusters and being adjustably secured therein, said first and second adjusters being adjustable along said length of said stabilizing member which corresponds to a desired angle of rotation of one of said walers with respect to another of said walers.

16. A form assembly, as claimed in claim 15, wherein each of said adjusters further includes:

a split ball member having two ball halves, each of said ball halves having a curved shape;

a pair of sockets engagable with said halves, each one of said pair of sockets including an engaging surface conforming to said shape of said halves; and a pair of securing members selectively engagable against said pair of sockets.

17. A form assembly, as claimed in claim 15, further including:

at least one strongback mounted perpendicularly to one of said walers.

18. A form assembly, as claimed in claim 16, wherein each of said walers further includes:

an adjustment plate having a first end attached at said adjacent end of each of said at least two walers, and having a second end extending between said two ball halves, each of said ball halves being mounted on opposite sides of said second end.

19. An assembly, as claimed in claim 15, further including:

an adjustment plate at each of said adjacent ends and extending away therefrom, each said adjustment plate having an end to which one of said respective two adjusters are attached.

20. A form assembly, as claimed in claim 17, further including:

at least one connector extending from said at least one strongback;

at least one connector plate having a slot, said at least one strongback being mounted to one of said at least two walers by said connector extending through said connector plate wherein said strongback is positionable at different locations along said one of said at least two walers and delimited movement of said connector by said slot.

21. An adjustable radius form assembly comprising:

at least two horizontal members having adjacent ends connected to one another at a connection at said adjacent ends, said at least two horizontal members being pivotable with respect to one another at said connection to a desired angle of rotation; and means for adjusting said angle of rotation between said at least two horizontal members, said adjusting means including a stabilizing member, and a ball and socket adjuster for releasably retaining said stabilizing member at a desired location along said stabilizing member, said angle of rotation between said at least two horizontal members being definable as said location in which said ball and socket adjuster is positioned along said stabilizing member.

22. A form assembly, as claimed in claim 21, further including:

a vertical member attached perpendicularly to each of said adjacent ends of said at least two horizontal members, said adjusting means interconnecting said vertical members.

23. A form assembly, as claimed in claim 21, wherein:

said retaining means is two ball and socket adjusters, one ball and socket adjuster being attached to one of said vertical members and the other of said ball and socket adjusters being attached to another of said vertical members.

24. A form assembly, as claimed in claim 21, further including:

an adjustment plate at each of said adjacent ends and extending away therefrom, each said adjustment plate having an end to which said retaining means is attached.

25. A form assembly, as claimed in claim 21, wherein said retaining means includes:

a channel formed therethrough for receiving said stabilizing member, said channel being of a desired size which determines a range of rotation between said horizontal members.

26. A form assembly, as claimed in claim 21, further including:

a pair of end plates extending longitudinally from a corresponding one of each of said adjacent ends; and a pin interconnecting said end plates at said connection, said end plates extending an amount which enables said at least two walers to be pivotable with respect to one another without interference.

27. An adjustable radius form assembly for use in the construction of curved walls, said form assembly comprising:

at least two laterally spaced vertical strongbacks;

at least two vertically spaced walers;

at least two vertically spaced connectors extending from each strongback, said connectors being equally spaced along each strongback;

means for holding each of said connectors in a fixed position along said strongbacks; and a first fastener on each of said connectors for releasably securing said walers to said strongbacks.

28. A form assembly, as claimed in claim 27, wherein:

said holding means is a bore in each of said plurality of strongbacks.

29. A form assembly, as claimed in claim 27, wherein:

said holding means is a second fastener on said connector for holding said corresponding waler against said at least one of said plurality of strongbacks.

30. A form assembly, as claimed in claim 27, wherein:

said connector is a threaded bolt; and said first fastener is a nut threadably received on said connector.

31. A form assembly, as claimed in claim 27, wherein:

said connector is a screw; and said first fastener is a head on said screw.

32. A method of constructing a curved shaped form assembly comprising the steps of:

providing a first set of at least two horizontal members connected together at adjacent ends;

determining a desired curvature;

adjusting a group of first two horizontal members of the first set to the desired curvature by:

(i) pivoting one horizontal member with respect to the other horizontal member at the adjacent ends;

(ii) releasably securing the one horizontal member with respect to the other horizontal member to maintain a first angle of rotation;

connecting a third horizontal member to the group of the first set;

pivoting the third horizontal member with respect to an opposite end of one of the first two horizontal members;

releasably securing the third horizontal member to create a second angle of rotation with respect to one of the first two horizontal members;

mounting a plurality of vertically extending members to the horizontal members; and adjusting the horizontal spacing between the vertically extending members.

33. A method, as claimed in claim 32, further including the step of:

providing a second set of horizontal members;

adjusting the curvature of the second set of horizontal members to match the curvature of the first set of horizontal members; and attaching the second set of horizontal members to the vertically extending members and spaced a vertical distance from the first set of horizontal members.

* * * * *